United States Patent [19]

Abeene et al.

[11] Patent Number: 4,777,900

[45] Date of Patent: Oct. 18, 1988

[54] OAR STORAGE AND CARRYING RACK FOR BOATS

[76] Inventors: Claris D. Abeene, 2634 Gay St., Eugene, Oreg. 97401; Michael J. Eaton, 941 N. 5th, Springfield, Oreg. 97477

[21] Appl. No.: 56,431

[22] Filed: Jun. 1, 1987

[51] Int. Cl.[4] ..... B63B 17/00

[52] U.S. Cl. ..... 114/343; 114/364; 440/104

[58] Field of Search ..... 114/343, 364; 440/104; 224/273; 211/60.1

[56] References Cited

U.S. PATENT DOCUMENTS 2,497,797 2/1950 Rogers ..... 114/364 X 3,740,780 6/1973 Knipple ..... 114/364

4,516,941 5/1985 Reid ..... 114/364 X

*Primary Examiner*—Sherman D. Basinger

*Attorney, Agent, or Firm*—James D. Givnan, Jr.

[57] ABSTRACT

A plate structure and keeper define open areas for the reception of boat oars. The keeper is hingedly mounted to the plate structure as well as lockable thereto to prevent oar theft. At one end of the plate structure are appendages which protrude outwardly through brackets mounted on the boat. The brackets define slot-like openings to receive the appendages for holding the plate structure in an elevated operative position. The plate structure is downwardly stowable in a lowered position and confined against fore-and-aft movement upon the appendages being reorientated in the slot-like openings accomplished by lifting and downward rotation of the plate structure.

4 Claims, 1 Drawing Sheet

OAR STORAGE AND CARRYING RACK FOR BOATS

BACKGROUND OF THE INVENTION

The present invention pertains generally to racks for securing oars in a boat against theft or accidental loss.

Theft of oars from moored boats or trailered boats in transit is not uncommon. Attempts to provide oar storage racks to prevent the foregoing have resulted in rack structures which constitute an obstruction to hinder movement about the boat. As not suitable oar securing racks are in wide use today, the loss of oars occurs with some frequency to interrupt a fishing trip and with a monetary loss to the boat owner.

Top quality oars represent considerable cost to the boat owner, who accordingly prefers to isolate the oars during travel from contact with the boat and items of gear which isolation is not provided by known oar racks.

SUMMARY OF THE PRESENT INVENTION

The present invention is embodied in an oar rack which carries the oars in an elevated manner and is conveniently repositionable to an inconspicuous position during use of the boat.

A plate structure is held upright to extend above the boat seats to receive the oars secured therein. The structure is repositionable through 180 degrees or so to a stowed position during boat use. Appendages on the structure removably engage surfaces on a pair of brackets mounted in place on an upright boat surface. Such bracket surfaces retain the plate structure in place until intentionally repositioned by the user. The brackets are shaped to receive the plate structure appendages to maintain same and the plate structure upright against whatever violent motions the boat may encounter either during trailering or when afloat.

Important objectives of the oar storage rack include the provision of a rack for positioning boat oars so as to be isolated from contact with the boat or items of gear stowed therein; the provision of an oar storage rack that is positionable from a raised operative position to a lowered or stowed position simply by exerting a lifting force on the rack and thereafter rotating same through 180 degrees; the provision of an oar storage rack supported in operative and unoperative positions by a gravity type locking arrangement; the provision of an oar storage rack having a plate structure which overlies rack mounting fasteners to prevent their removal and theft of the rack; the provision of an oar storage rack having components lending themselves to low cost production methods; the provision of an oar storage rack which is stowed adjacent an upright bulkhead surface of the boat in an unobtrusive manner.

DETAILED DESCRIPTION OF THE PREFERRED EMBODIMENTS

Figure 1:
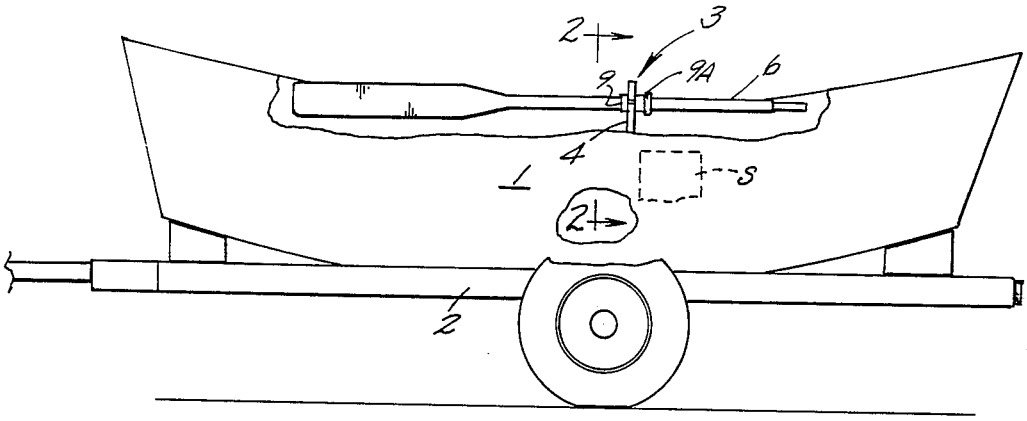
FIG. 1 is a side elevational view of a rowboat on a trailer with the present rack operatively disposed in the boat.

With continuing attention to the drawings wherein applied reference numerals indicate parts similarly hereinafter identified, the reference numeral 1 indicates a boat which may be of the type referred to as a white water boat and having somewhat raised stern and bow. The boat is shown in place on a trailer 2.

Indicated generally at 3 is the present oar holder. The holder is generally of plate construction having a plate structure at 4 adapted by means of recessed upper edges at 5 to receive oars at 6. Not uncommonly "white water" boaters will carry a spare oar. A keeper 7 of the holder has recessed edges at 8 to fit about oars with the semicircular edges 5 and 8 being sized to receive an oar cuff 9 but small enough to prevent passage of an oar blade or cuff ring at 9A. If desired, the surfaces of edges 5 and 8 may be lined with a resilient material.

A pivot pin at 10 at one end of the plate structure receives a hinge 11 on keeper 7 to permit opening movement of the keeper about the axis of pivot pin 10. A latch member at 12 on the keeper is apertured at 12A with the plate structure having an aligned aperture (not shown) to receive the hasp 13 of a padlock 14. Plate structure appendages are at 15 and 16. The hinge 11 and latch member 12 may be attached by welds as at W.

Brackets at 17 and 18 are suitably secured to an upright surface 19 of the boat which surface may be a supporting wall of a seat S. Bracket surfaces as at 17A–17B define open areas of elongate shape to receive appendages 15 and to retain said appendage and the plate structure in a vertical position. Bracket 18 is identical with regard to the foregoing description. Openings as at 20–21 in the brackets are of a size to permit rotation of the appendages through 180 degrees prior to reinsertion into the open area above noted. The plate structure is accordingly held in upright disposition by the appendages being in downwardly rested engagement with the bracket defined open area until manually elevated and repositioned through 180 degrees.

Figure 2:
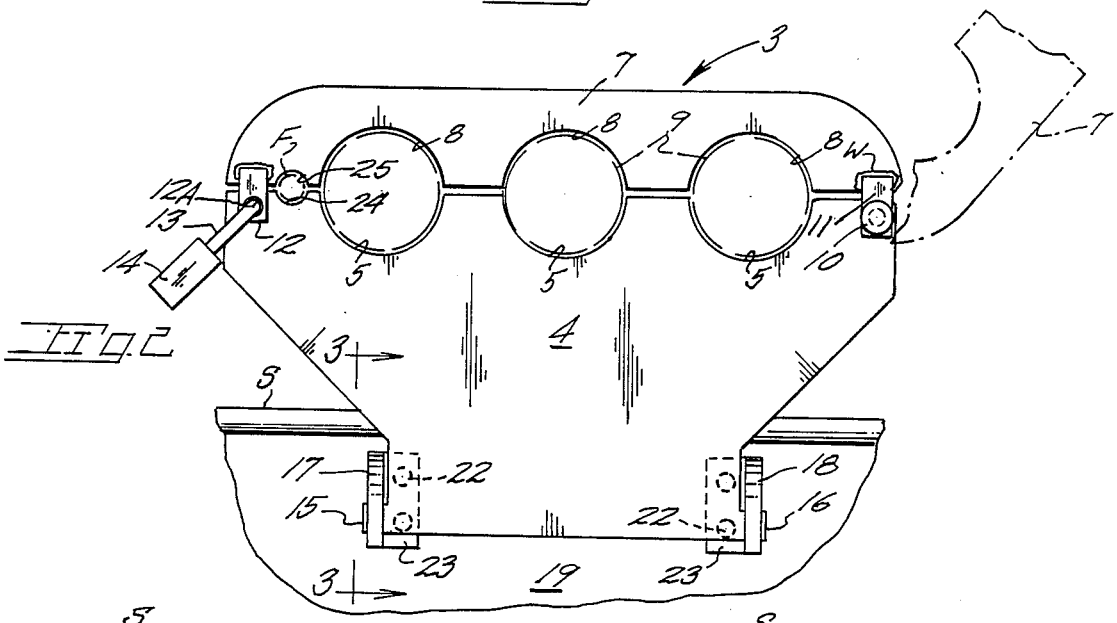
FIG. 2 is a vertical elevational view taken along line 2—2 of FIG. 1.
Figure 3:
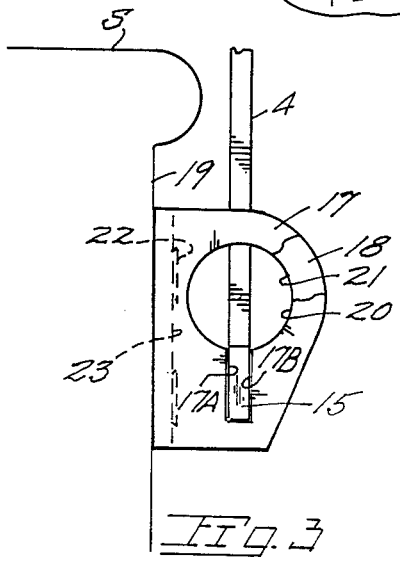
FIG. 3 is a vertical elevational view taken along line 3—3 of FIG. 2.
Figure 4:
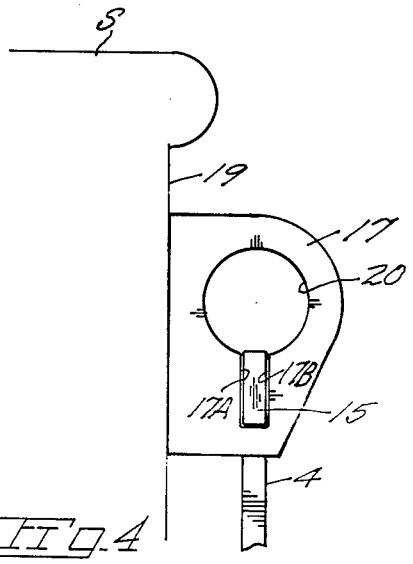
FIG. 4 is a view similar to FIG. 3 but with a plate component of the rack rotated downwardly through 180 degrees to a stowed depending position.

It is to be noted that the plate structure in the raised position of FIG. 2 serves to block access to bracket mounting fasteners 22 passing through a bracket flange 23 to prevent removal. The plate structure 4 is not rotatable of course with the oars locked in place therein.

Recesses at 24 and 25 in plate 4 and keeper 7 define an opening to receive the frame F of a landing net to lock same in place.

Stowing of the oars and net in a raised manner greatly lessens the risk of injury from stepping on an oar or landing net handle when boarding the boat.

While I have shown but one embodiment of the invention, it will be apparent to those skilled in the art that the invention may be embodied still otherwise without departing from the spirit and scope of the invention.

Having thus described the invention, what is desired to be secured in a Letters Patent is:

I claim:

1. An oar holder for storing oars in a locked manner in a boat and for installation in a positionable manner on an upright surface of a boat seat, said holder comprising in combination, a plate structure having multiple oar supporting surfaces and keeper means, said keeper means adapted to receive a padlock, said plate structure having a raised position and a lowered position, appendages on said plate structure, and bracket means for attachment to said upright surface of a boat seat having upright surfaces defining elongate open areas, said surfaces engaged by the appendages so as to maintain the plate structure in said raised position to support oars resting on at least some of said supporting surfaces in a horizontal manner, said bracket means also defining openings in downward communication with said elongate open areas and into which openings said appendages may be temporarily positioned to permit rotation of the appendages during raising and lowering of the plate structure.

2. The oar holder claimed in claim 1 wherein said bracket means comprises a pair of brackets, each of said brackets having pairs of said surfaces serving to retain the appendages and the plate structure in vertical disposition.

3. The oar holder claimed in claim 2 wherein said bracket means includes fasteners engageable with the boat seat, said plate structure overlying said fasteners when in a raised position to prevent removal of the fasteners to prevent theft of the oar holder.

4. The oar holder claimed in claim 1 wherein said plate structure and said keeper means have recessed edges defining oar receiving openings, additional recessed edges defining an open area to receive a landing net frame.

* * * * *